United States Patent [19]

Fiorentino

[11] Patent Number: 4,647,426

[45] Date of Patent: Mar. 3, 1987

[54] PRODUCTION OF BILLET AND EXTRUDED PRODUCTS FROM PARTICULATE MATERIALS

[75] Inventor: Robert J. Fiorentino, Worthington, Ohio

[73] Assignee: Battelle Memorial Institute, Columbus, Ohio

[21] Appl. No.: 812,742

[22] Filed: Dec. 23, 1985

[51] Int. Cl.[4] ..... B22F 1/00

[52] U.S. Cl. ..... 419/31; 264/58; 264/65; 264/125; 264/176.1; 419/23; 419/24; 419/41; 419/44; 419/48; 419/53; 419/60

[58] Field of Search ..... 419/23, 24, 31, 41, 419/44, 48, 53, 60; 264/58, 65, 125, 176 R

[56] References Cited

U.S. PATENT DOCUMENTS

| | | | |
|---|---|---|---|
| Re. 31,355 | 8/1983 | Rozmus | 419/49 |
| 4,041,742 | 8/1977 | Rozmus | 419/30 |
| 4,142,888 | 3/1979 | Rozmus | 419/49 |
| 4,478,787 | 10/1984 | Nadkarni et al. | 419/50 |
| 4,602,952 | 7/1986 | Greene et al. | 419/49 |

*Primary Examiner*—Stephen J. Lechert, Jr.

*Attorney, Agent, or Firm*—Robert B. Watkins; Philip M. Dunson

[57] ABSTRACT

Methods and apparatus are disclosed for consolidating loose or pre-compressed particulate materials, such as metal powder or metal flakes, in press equipment utilizing a reusable canister means that is sealed in vacuum from the atmosphere and heated prior to consolidation in the press equipment at elevated pressures and temperatures, thereby improving utilization of the press equipment.

7 Claims, 5 Drawing Figures

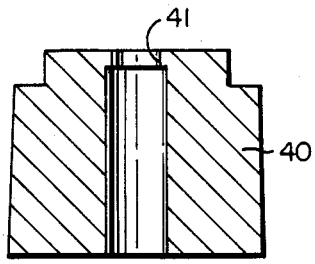
FIG. 2
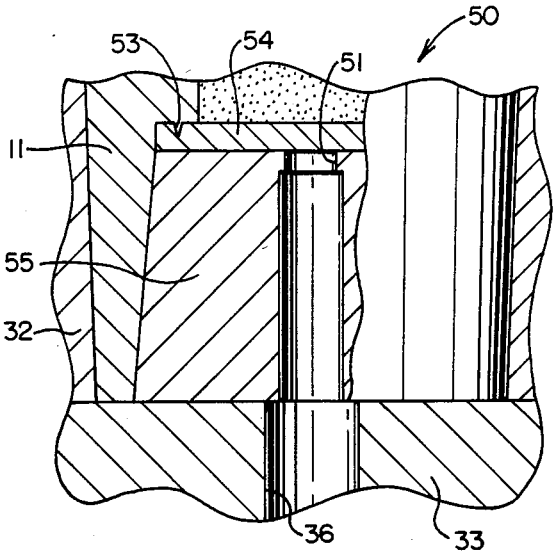
FIG. 3
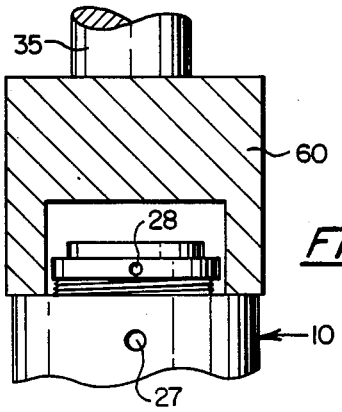
FIG. 4
FIG. 5
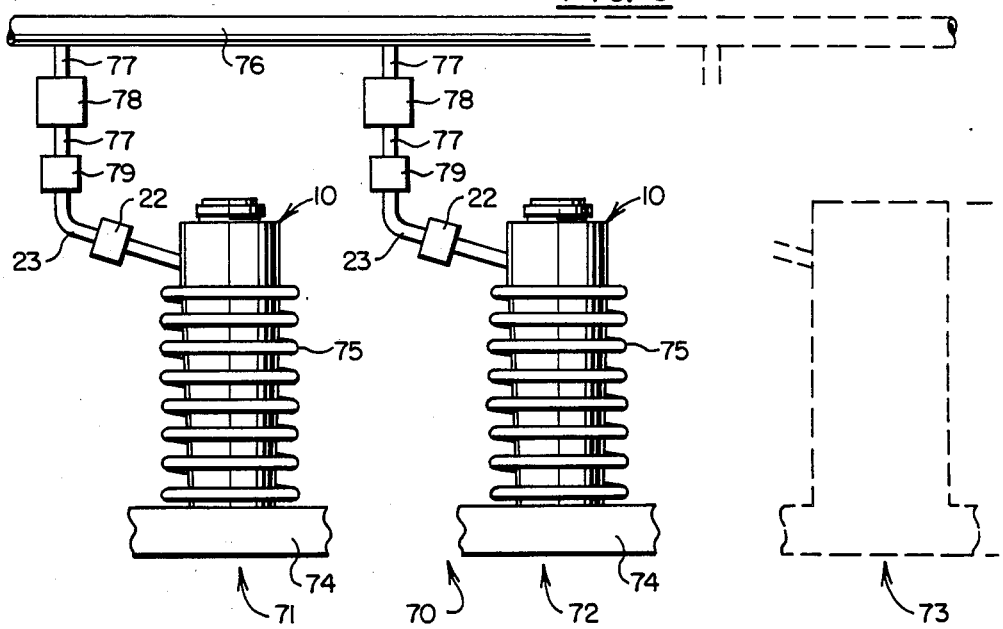

PRODUCTION OF BILLET AND EXTRUDED PRODUCTS FROM PARTICULATE MATERIALS

FIELD OF THE INVENTION

This invention relates generally to the production of billet and extruded products from particulate materials such as powdered-or flaked-metal, ceramics, polymers, or composites of these materials, and particularly concerns both apparatus and methods useful in the consolidation of particulate materials into billet stock or various extruded shapes. The apparatus utilizes a novel canister/receptacle means which serves to define the shape of the formed billet or extrusion, which is subsequently reused when repeating the process steps for additional production, and which significantly enhances the process of consolidating the particulate material. Through use of the reusable canister means, the process advantageously permits controlled heating and outgassing of the contained charge, separate from the consolidation press equipment thereby realizing a more efficient utilization of the press equipment.

BACKGROUND OF THE INVENTION

It is generally known to use particulate materials such as powdered-or flaked-metal, for the production of products such as billets and extrusions. In the conventional practice, the particulate metal charge, loose or partially pre-compressed, is placed into a can-like vessel and the vessel is then sealed except for an evacuation tube for outgassing, if required. The vessel and charged metal are then heated to an elevated temperature and outgassed. After sealing off the evacuation tube, the heated vessel/metal charge combination is placed in an autoclave or other pressure-inducing receiver and subjected to an elevated fluidic or gaseous pressure frequently to the level of from 5,000 to 15,000 p.s.i. Deformation of the sealed vessel and contained metal charge at the elevated pressure and temperature conditions, results in a consolidation of the particulate metal to a density substantially equaling the theoretical maximum density that may be achieved for the metal being processed. Afterwards, the vessel is removed from the autoclave, cooled, and opened for billet removal by longitudinal slitting and by cutting away the ends, for instance.

In another prior art practice, the particulate metal is placed in a thin closed metal can, heated to an elevated temperature, outgassed if necessary, and then placed into a thick-walled container or press receiver for consolidation and/or extrusion by a press ram. The extrusion process may involve extruding the can as well as the consolidated particulate metal. Subsequently the extruded can is removed from around the consolidated metal shape as by turning, grinding, or selective etching.

U.S. Pat. No. 4,094,672—Fleck et al. consolidates high-speed-steel-powder metal at temperatures on the order of 2000° F. in a sealed can and at isostatic autoclave pressures on the order of 10,000 to 15,000 p.s.i. Following consolidation of the contained charge, the sealed can is subjected to an interior positive pressure sufficient to cause the can to expand away from the consolidated metal. Afterwards, the end plates of the can are removed by sawing and the consolidated metal shape is withdrawn from the can through either opened end. The Fleck et al. can is stated to be reusable.

U.S. Pat. No. Re. 28,301—Havel teaches a method of consolidating and particulate metal placed in a glass can and subsequently located in a molten glass bath that is heated to a temperature approaching 2350° F. and a gas pressure of 15,000 p.s.i. The vitreous can collapses upon cooling and therefore is not reused.

U.S. Pat. No. 2,123,416—Graham teaches the use of a conventional extrusion press ram, bed, and receiver (liner) equipment for consolidating and extruding particulate metals into useful shapes. The patent discloses placing the particulate metal in a closed can, heating the can and metal to an elevated temperature, either at the press station which is used to accomplish extrusion or at a station removed from the extrusion station; and subsequently extruding both the consolidated material and the can following compaction. The extruded can is either allowed to remain on the resultant extruded article as a cladding or is removed by etching or machining, for instance.

U.S. Pat. No. 3,559,271—Nilsson teaches use of a hydraulic fluid medium to pressurize a pre-compressed and pre-coated powdered-metal billet to accomplish billet extrusion. No heating of the billet to elevated temperatures is involved.

U.S. Pat. No. 3,220,199—Hanlein et al. teaches heating pre-compressed metallic powder placed in a press receiver and afterwards extruding the heated pre-compressed metal through a glass lubricated extrusion die. In instances in which a metal can is utilized to encapsulate the pre-compressed metal the can is also extruded with the metal and subsequently serves as a thin cladding.

DISCLOSURE OF INVENTION

Basically, the apparatus of this invention comprises a rigid, tubular canister means that has a tapered exterior surface and an interior of nominally constant cross section over its effective length. This interior portion may have a slight diverging taper to facilitate billet removal after consolidation. The lower interior portion of the canister/receptacle means is closed by a blind die (or by an extrusion die depending upon the nature of the product to be produced). The upper interior portion of the canister means is closed, after insertion of the particulate material charge, by a sealing means that subsequently permits axial motion of a ram to achieve metal consolidation in a conventional press arrangement. The canister means is also provided with a valved exhaust tube that is selectively connected to a vacuum source. The assembled and sealed canister means and contained charge of loose or partially pre-compressed particulate material cooperates with a conventional induction heating coil or similar apparatus and with a vacuum source to achieve heating and outgassing of the charge prior to removal to a conventional press for material consolidation with a press ram. The assembled canister means is removably inserted into a matching-tapered press container and may be subjected to a degree of hoop compression from the container prior to material consolidation at the desired elevated pressure.

From a method standpoint, the invention involves the sequential steps of closing the lower extreme of the canister assembly in sealed relationship to the environment, placing a charge of loose or pre-compressed particulate material into the canister interior, closing the upper extreme of the canister assembly with a sealing disc (an example of one sealing means), connecting the canister to a vacuum supply, placing the entire assembly in a heating source while connected to the vacuum supply, heating and outgassing the material charge in a time-temperature-pressure sequence appropriate to the material, optionally maintaining the final desired vacuum or closing the connection to the vacuum supply after the desired vacuum and temperature level has been achieved, optionally maintaining connection or disconnecting the assembly from the vacuum supply completely sealed from the environment, and removing the assembly to a press for installation in a press container for external support by hoop compression.

Subsequentially a press ram or punch engages the canister assembly, shears the upper sealing disc, and compresses the particulate material charge at its elevated temperature to a billet having substantially 100% of theoretical density.

Afterwards the consolidated particulate material is ejected from the canister means as a billet by the press ram, or further subjected to an extrusion operation. In the latter and alternate embodiment of the invention, the extrusion operation may be accomplished after consolidation of the particulate material but prior to the canister means being separated from the press receiver.

It is well known that consolidation/extrusion processes are practiced horizontally as well as vertically. The terms "upper" and "lower" are used herein to denote opposite ends, and would be opposite to each other in the horizontal practice of the invention.

The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art, without departing from the scope or sacrificing any of the advantages of the invention.

DESCRIPTION OF THE DRAWINGS

In the drawings:

FIG. 2 is a sectional elevational view of an extrusion die means that may be used with the canister means of FIG. 1;

FIG. 3 is a sectional elevational view of an alternate embodiment of canister means having a sealed extrusion die closure provided in lieu of a sealed blind die closure;

FIG. 4 is a sectional view of an adaptor that may be used when installing the canister means of this invention into a press receiver under hoop compression; and FIG. 5 is a schematic illustration of a system having separate stations for simultaneously preheating and outgassing several canister assemblies and contained charges in the practice of the method of this invention.

BEST MODE FOR CARRYING OUT THE INVENTION

Figure 1:
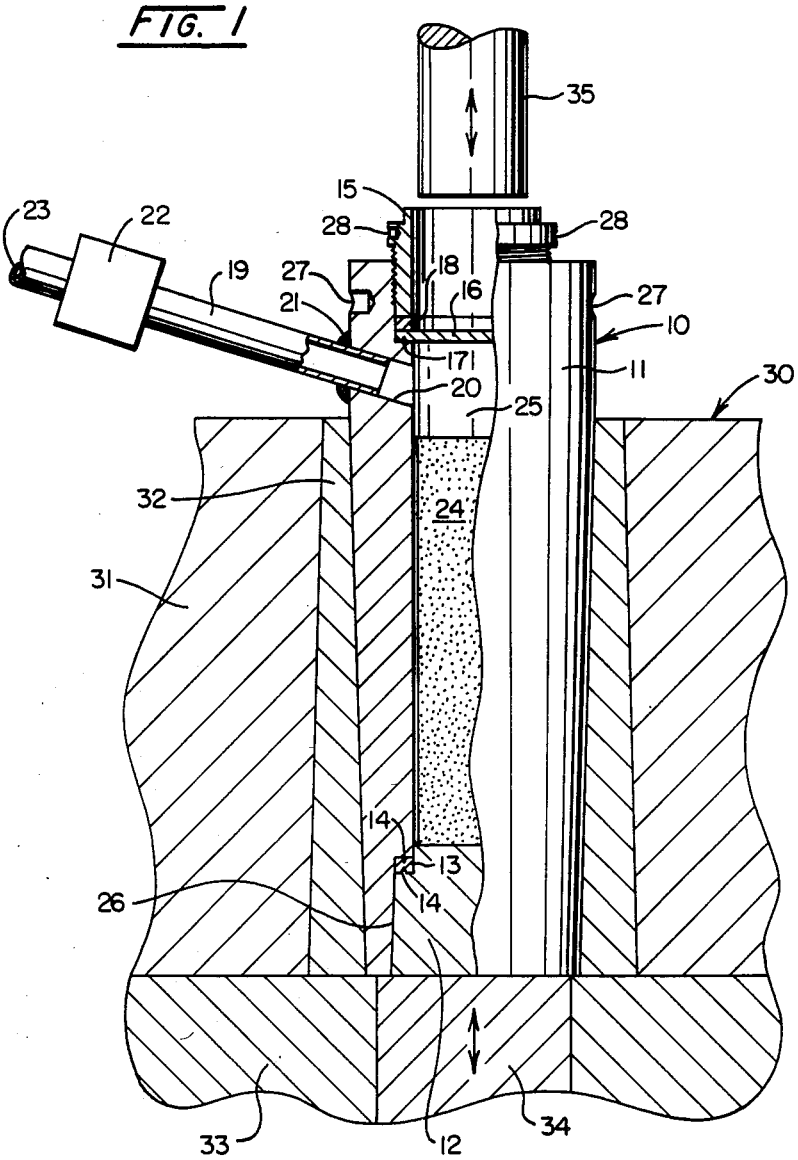
FIG. 1 is a partial sectional view of a preferred embodiment of the novel canister means of this invention, illustrated in its assembled operational relationship to the ram, bed, and receiver of a conventional hydraulic press installation.

FIG. 1 illustrates a canister means 10 having a tapered body member 11 preferrably made of an alloy steel such as a hot-work tool steel. The lower extreme of sleeve 11 is closed by a blind die 12. Blind die 12 has an exterior tapered surface 26 that engages a correspondingly tapered surface in the lower extreme of sleeve 11. A relatively soft metal sealing ring 13 provides a sealed relationship as between the environment and the lower interior of sleeve 11 through its engagement with annular knife edges 14 machined into a lateral offset in the lower extreme of sleeve member 11 and die 12. Vacuum sealing means other than the knife-edge/soft-metal method may also be used.

The upper extreme tubular body of member 11 is closed from the exterior environment by a relatively soft metal sealing disc 16 retained in position by an interior annular plug 15. The disc 16 engages a knife edge 17, similar to the knife edges 14. An anti-galling or slip ring 18 is placed between the sealing disc 16 and annular plug 15 so that the integrity of the seal between disc 16 and knife edge 17 may be achieved and maintained during threaded engagement of the annular plug 15 with the sleeve member 11. A durable exhaust tube 19 is engaged with a passageway 20 in body member 11, and is fixed in place by a weld 21 or other means which is vacuum-tight. A conventional manual vacuum valve 22 engages the exhaust tube 19 and cooperates with a vacuum supply connecting tube 23. Threaded connections may be utilized in lieu of welded connections.

Also as shown in FIG. 1, a loose or pre-compressed particulate metal compact 24 is placed in the interior of canister means 10. This is accomplished during the assembly of the canister means components.

Conventional hydraulic press equipment, such as a typical extrusion receiver, designated generally as 30 in FIG. 1, cooperates with the canister means 10. A receiver comprised of restraining rings 31 and 32 (assembled together through a shrink or press fit) is held in place against the press bed 33 by hydraulic means or with conventional threaded fasteners (not shown). An ejector pin 34 may be positioned within or on bolster plate 33 to eject the canister assembly 10 from within restraining rings 31, 32 after particulate metal consolidation and/or extrusion has been completed. A conventional press ram or punch 35 is arranged to engage the upper portion of canister means 10. Punch 35 has a cross sectional configuration that corresponds to the hollow interior cross sectional configuration of the canister body 11 and the annular plug 15. The interior surface of restraining ring 32 is tapered to correspond to and sized to achieve an interference press fit with the external surface taper of tubular sleeve member 11. Blind holes 27 and 28 are provided in sleeve member 11 and in an annular plug 15, respectively, as one means to facilitate gripping, during the threading of the plug means 15 into body member 11.

The blind die means 12 is normally used for the purpose of forming a billet of consolidated particulate metal in canister means 10. If it is desired to extrude the so-formed billet, the blind die means 12 is replaced after charge consolidation by an extrusion die 40. As shown in FIG. 2, extrusion die 40 has an extrusion opening 41. After extrusion is complete, the unextruded butt and die may be ejected from the sleeve 11 by common practice.

An alternate embodiment of canister assembly suitable for the practice of this invention is illustrated in FIG. 3. As shown in that figure, a canister means assembly 50 with sleeve member 11 and with an extrusion opening 51 formed in a mating extrusion die 55. An annular knife edge 53, similar to the knife edges 14, is provided in member 11 for engagement with sealing disc 54. In the FIG. 3 arrangement, an opening 36 is provided in the press bed 33 to facilitate the extrusion process. Canister assembly ejection is then accomplished by means (not shown) of placing a hardened steel disc of a diameter less than that of the sleeve 11 at the lower end, between the sleeve 11 and press bed 33, and pushing down on rings 31 and 32 with sufficient force. The canister means embodiment 50 is useful in those instances where it is desired to extrude a product from particulate material without having to remove a blind die closure 12 and replace it with an extrusion die 40.

The extrusion die 40 or 55 may have a converging conical-entry or streamlined-entry to the die orifice, instead of the flat face as shown, if preferred. In that event, die lubricant may be used.

The remaining apparatus utilized in the practice of this invention is illustrated schematically in FIG. 5. As shown in that figure, a preheating and outgassing system 70 is comprised of multiple work stations 71 through 73. Each work station has a base support 74 for supporting a canister means 10 and an induction heating coil 75 or other heat source. A vacuum supply header 76 is connected to each work station through a takeoff line 77, a vacuum shutoff valve 78, and a vacuum disconnect fitting 79. Each vacuum disconnect fitting 79 is selectively connected to a vacuum exhaust line 23 of a canister assembly 10. The valves 78 and 22 are normally opened when sealed canister means 10 is connected to the system at disconnect fitting 79 for heating and outgassing. Such valves are closed prior to removal of canister means 10 from its work station after heating and prior to metal consolidation.

The method aspects of the present invention can best be described with respect to the illustrated apparatus. First, a sleeve member 11 is normally combined with a properly engaged blind die member 12 or extrusion die member 40, 55 and the cooperating seal 13 or 54, depending upon the product that is to be produced. In each case it is important that the lowest face of of the assembled blind die or extrusion die be positioned to have proper support on bed 33 when the canister means assembly 10 is fully and forcefully engaged with press receiver ring 32. It is preferred that the interior surface of the tubular body member 11 and the closure die 12 be provided with a suitable release coating or lubricant prior to placing the particulate metal charge within canister assembly 10. Inorganic coatings, such as a glass, or other conventional non-volatile, non-migratory compositions may be used for this purpose.

Next, the particulate metal charge is placed in the sleeve member 11. The charge, which can be loose but normally is made up of one or more pre-compressed compacts in which the particulate metal has been pressed to about 70% to 80% of theoretical density. Normally the pre-compression step is accomplished at room temperature and using moderate press pressures. Next, the sleeve 11 is closed at its upper extreme with a sealing disc 16 and with the threaded annular plug member 15 and slip ring 18. When the assembly has been completed, the combined components are then loaded into one of the work stations shown in FIG. 5 and the vacuum exhaust line 23 connected by disconnect 79 to line 77 of the vacuum supply, with valves 78 and 22 being in an open condition. The canister assembly with included particulate metal charge is heated to an elevated temperature by a suitable heating means, e.g., by induction heating coil 75, while maintaining the interior of canister assembly 10 at a vacuum condition. When the proper elevated temperature has been reached within assembly 10, valves 22 and 78 are closed and the assembly is disconnected from vacuum supply 76 at fitting 79. The assembly in its heated and outgassed condition is then placed in the press equipment 30 and tapered body member 11 is brought into interference engagement with the corresponding tapered restraining ring 32 by use of an adaptor 60, such as shown in FIG. 4, and press ram 35, thus inducing a degree of hoop compression in body member 11. With the body member 11 properly restrained in the restraining ring 32, the punch 35 is brought into engagement with assembly 10 at the face of the seal disc 16.

Seal disc 16 is then sheared at the interior surface of body 11 by the ram 35, and the travel of ram 35 continues until there is engagement of the seal disc 16 with the upper surface of charge 24. A short steel disc or dummy block 25 with a smaller annular clearance with the inside surface of sleeve 11 than ram 35 may be used between the seal disc 16 and charge 24, if desired, to relax the alignment requirements between the ram 35 and inner surface of sleeve 11 and, thus, avoid potential tooling damage. Press ram movement continues further until the desired pressure is induced into the particulate metal charge.

In the case of compacting or consolidating powdered aluminum materials, for instance, a press ram stem pressure of approximately 100,000 p.s.i. is preferred (and a charge temperature of approximately 600° to 900° F.) to get proper consolidation. The hot pressing time is typically about one minute.

There are three typical modes of operation that may be used when consolidation is completed. In the one case where the immediate product required is just the consolidated billet, both the blind die 12 and consolidated billet are ejected from the sleeve 11 by the ram 35. In the case where an extrusion is preferred immediately, then one approach is to remove the blind die 12 and replace it with an extrusion die 40, after which the still-hot consolidated billet is extruded through the die. Another variation of the latter case is to use, instead of a blind die, a normal extrusion die but with a vacuum sealing means, e.g., a soft metal disc, to cover the die orifice for the prior vacuum-degassing step, as shown in FIG. 3.

After billet ejection or extrusion is completed, the sleeve 11 is removed from restraining ring 32 by ejector pin 34. Sleeve 11 may also be ejected by placing a hardened steel disc between receiver 30 and bolster plate 33, the disc outside diameter being smaller than the minimum inside diameter of restraining ring 32. Then a load is applied to the top surface of restraining rings 31 and 32 sufficient to break loose the sleeve 11 from its interference fit with ring 32.

The apparatus and method of the present invention have been utilized to process a number of different particulate metals into both billet and extrusion shapes. Specifically, the apparatus and method of this invention had been utilized to form billets from 7075, 7091, and PM 64 aluminum alloys. Also, the apparatus and method of this invention have been utilized to produce extrusions directly from the consolidated step of 7075 aluminum alloy. It is believed that the apparatus and method of the invention also has utility in the processing of other particulate materials, such as powdered magnesium, titanium, and copper metals and their alloys, ceramics, polymers, and composites.

In one instance, a 7075 particulate metal consisting of elongated flakes or fibers in the range of 25–50 microns thickness by $\frac{1}{8}$ inch long by 0.018 inch wide, were precompressed in a mechanical press die pressing to 73% of theoretical density at room temperature. A pre-compressed billet of the material was placed in a canister assembly 10, similar in construction to the canister means shown in the drawings. The canister assembly had a blind die closure 12 at its lower extreme and the upper extreme was closed by a sealing disc 16 and top plug 15 to provide a closed interior sealed from the atmosphere and connected to an exhaust tube 19. The assembly was placed in a work station for preheating by an induction heating coil. During the heating to a temperature 900° F. the interior of canister assembly 10 was connected to a vacuum source to develop the internal pressure of canister assembly 10 to a level of 50 microns of mercury (Hg) or less. When the compact in canister 10 attained a temperature of 900° F., the canister assembly 10 was transported from the preheating work station to a hydraulic press installation and was lowered into place within cooperating a restraining ring 32. An adaptor fitting 60, was placed over the canister assembly and the ram 35 of the press equipment brought into engagement. The press then was further actuated to force canister assembly 10 at its tapered surface into complete interference engagement with the correspondingly tapered interior surface of restraining ring 32 to thus place the canister assembly 10 into a degree of hoop compression. When properly installed within the press receiver, the sealed canister assembly had a lower face at the blind die closure member 12 that was properly supported on bed 33 of the hydraulic press. With the canister assembly properly positioned, the adaptor 60 was removed from cooperation with the canister assembly 10 and the punch or ram 35 of the hydraulic press was brought close to engagement with the sealing disc 16. Thereafter, continued very rapid downward movement of press ram 35 sheared sealing member 16, breaking the vacuum of the interior of canister assembly 10 for a fraction of a second. Sealing member 16 was immediately forced into contact with the preheated billet 24 and hydraulic pressure was continued to create a internal pressure of great magnitude which caused consolidation of the particulate metal compacts into a billet shape having approximately 100% of theoretical maximum density. Such step was accomplished using a stem pressure of the press ram of approximately 90,000 psi for a period of at least one minute. After consolidation was completed, the blind die 12 was replaced with an extrusion die 40. A press ram was brought into engagement with the consolidated billet at the nominal extrusion temperature of 900° F. and continued downward movement of the press ram caused an extrusion to be made from the billet shape at an extrusion ratio of 23:1. The press ram speed during extrusion was approximately 1 inch per minute.

In three other instances the same canister assembly 10 was utilized to form billet shapes and extrusions from a 7091 aluminum alloy particulate metal and from a PM 64 aluminum particulate metal. The 7091 alloy was of angular powder form, 12 to 15 microns diameter; the PM 64 metal was of elongated flake form 25–50 micron thickness by 0.060 inches long by 0.012 inches wide. In these cases, the consolidated billets were removed from assembly 10 and extruded optionally at another time at 600° F.

From the above summarized runs it may be readily concluded that a canister assembly 10 in accordance with the present invention may be used repeatedly. Other advantages of the invention are also readily apparent. For instance, since heating and outgassing of the compacted particulate metal may be done prior to consolidation in several canister assemblies simultaneously, higher cycle rates of the press equipment may be realized. Cost advantages may also be realized from the fact that the novel canister assembly of this invention is reusable and need not be replaced each time as is necessary with conventional press consolidation and extrusion technology.

A further advantage is that there is no can, so the canning and decanning operations are eliminated.

Although a preferred embodiment of the invention has been herein described, it will be understood that various changes and modifications in the illustrated and described structure can be effected without departure from the basic principles that underlie the invention. Changes and modification of this type are therefore deemed to be circumscribed by the spirit and scope of the invention, except as the same may be necessarily modified by the appended claims or reasonable equivalence thereof.

I claim:

1. A method of consolidating particulate material into product of a density substantially equal to theoretical maximum density comprising the sequential steps of:

a. loading loose or partially precompressed particulate material into a canister means having a tapered outer surface and closed and sealed lower extreme;
b. closing and sealing the upper extreme of said canister means with a closure and seal means;
c. heating said canister means and contained loaded material to an outgassing temperature while maintaining the interior of said canister means at a pressure significantly below atmospheric pressure;
d. heating or cooling said canister means and degassed particulate to a selected consolidation temperature, if different from the degassing temperature.
e. locating said heated canister means and degassed particulate material in a press receiver restraining ring means having an interior surface that is tapered to correspond to said canister means tapered outer surface;
f. shearing said upper closure and seal means and consolidating said particulate material at said consolidation temperature at a pressure which causes said heated particulate material to attain substantially 100% of theoretical maximum density;
g. ejecting said consolidated particulate material from within said canister means in unitary form; and
h. removing said canister means from within said press receiver restrainer ring.

2. The method of claim 1 wherein said canister means is forced into hoop compression by press-fitting the tapered outer surface of the canister means into the taper of the restraining ring means.

3. The method of claim 1 wherein said consolidated particulate material is ejected from within said canister means with a cross sectional area reduced from the cross sectional area of the interior of said canister means.

4. The method of claim 1 wherein the steps (a) through (h) are performed on a first material and repeated with said canister means using a second additional loose or pre-compressed particulate material following ejection of said the first material from within said canister means.

5. The method of claim 1 wherein said pre-compressed particulate material is pre-compressed to a density of from 70% to 85% of theoretical maximum density.

6. The method of claim 1 wherein said heating and outgassing step is accomplished while developing the interior of said canister means to a pressure of approximately 50 microns of mercury (Hg) or less.

7. The method of claim 1 wherein the shearing and pressing step f. is carried out by a press ram forcing a dummy block located below the sealing means, against the particulate material.

* * * * *